US010399089B1

(12) United States Patent
Shumway et al.

(10) Patent No.: US 10,399,089 B1
(45) Date of Patent: Sep. 3, 2019

(54) SYSTEM TO CONTROL A CHARGE VOLUME OF AN AUTOGENOUS MILL OR A SEMI-AUTOGENOUS MILL

(71) Applicants: Sheldon Dean Shumway, Pleasant Grove, UT (US); Sergei Kuznetsov, Eden Prairie, MN (US)

(72) Inventors: Sheldon Dean Shumway, Pleasant Grove, UT (US); Sergei Kuznetsov, Eden Prairie, MN (US)

( * ) Notice: Subject to any disclaimer, the term of this patent is extended or adjusted under 35 U.S.C. 154(b) by 408 days.

(21) Appl. No.: 15/404,062

(22) Filed: Jan. 11, 2017

Related U.S. Application Data

(60) Provisional application No. 62/277,648, filed on Jan. 12, 2016.

(51) Int. Cl.
*B02C 25/00* (2006.01)
*B02C 17/18* (2006.01)

(52) U.S. Cl.
CPC ..... *B02C 25/00* (2013.01); *B02C 17/1805* (2013.01)

(58) Field of Classification Search
CPC ..... B02C 25/00; B02C 17/1805; G05B 11/01; G05B 11/06; G05B 11/32
USPC ..... 241/33, 34, 35; 702/57, 141
See application file for complete search history.

(56) References Cited

U.S. PATENT DOCUMENTS 3,783,252 A * 1/1974 Putman ..... B02C 17/1805 241/34
4,212,429 A * 7/1980 Cuvelier ..... B02C 17/1805 241/26
4,404,640 A * 9/1983 Dumbeck ..... B02C 25/00 241/34
5,183,214 A * 2/1993 Zakheim ..... B02C 17/005 241/172
5,698,797 A * 12/1997 Fontanille ..... B02C 17/1805 250/357.1
6,719,610 B2 * 4/2004 Chou ..... B02C 17/005 241/171
6,874,366 B2 * 4/2005 Magne Ortega .... B02C 17/1805 73/644
9,751,088 B2 * 9/2017 Held ..... B02C 17/1805
2018/0126384 A1 * 5/2018 Robles Opazo .... B02C 17/1805

* cited by examiner

*Primary Examiner* — Faye Francis
(74) *Attorney, Agent, or Firm* — Nolte Intellectual Property Law Group

(57) ABSTRACT

A system to control in real time a charge volume of an autogenous mill or a semi-autogenous mill including at least one accelerometer connected to a rotatable mill shell producing acceleration over time signals. The system includes a wireless antenna, a signal receiver module, and a modular magnetic power generator unit communicating with a master control processor connected to a network and to a distributed control system of the mill. The system has computer instructions to receive the acceleration over time signals and compare the acceleration over time signals to preset charge limits and produce commands to the distributed control system to automatically alter at least one of: speed of the rotatable mill shell, a particulate feed rate, a water feed rate, and combinations thereof when compared acceleration over time signals exceed or fall below preset charge limits.

12 Claims, 5 Drawing Sheets

SYSTEM TO CONTROL A CHARGE VOLUME OF AN AUTOGENOUS MILL OR A SEMI-AUTOGENOUS MILL

CROSS REFERENCE TO RELATED APPLICATION

The current application claims priority to and the benefit of U.S. Provisional Patent Application Ser. No. 62/277,648 filed on Jan. 12, 2016, entitled "SYSTEM TO CONTROL A CHARGE VOLUME OF AN AUTOGENOUS MILL OR A SEMI-AUTOGENOUS MILL". This reference is hereby incorporated in its entirety.

FIELD

The present embodiments generally relate to a system to monitor the flow of material that constitutes a charge portion rather than a discharge portion in an autogenous (AG) mill or a semi-autogenous (SAG) mill for grinding particulates.

BACKGROUND

A need exists for a system that allows measurement of the flow of material that constitutes a charge to the mill, in real time, so as to prevent overfill of the mill.

The charge portion of the mill is different from the discharge portion of the mill, as the charge portion is ground based on three variables, a speed of rotatable mill shell of the mill, a particulate feed rate, and a water feed rate.

A need exists to have a system that requires no additional input of energy other that the spin of the rotatable mill shell to control the charge.

The present embodiments meet these needs.

BRIEF DESCRIPTION OF THE DRAWINGS

The detailed description will be better understood in conjunction with the accompanying drawings as follows.

Figure 1:
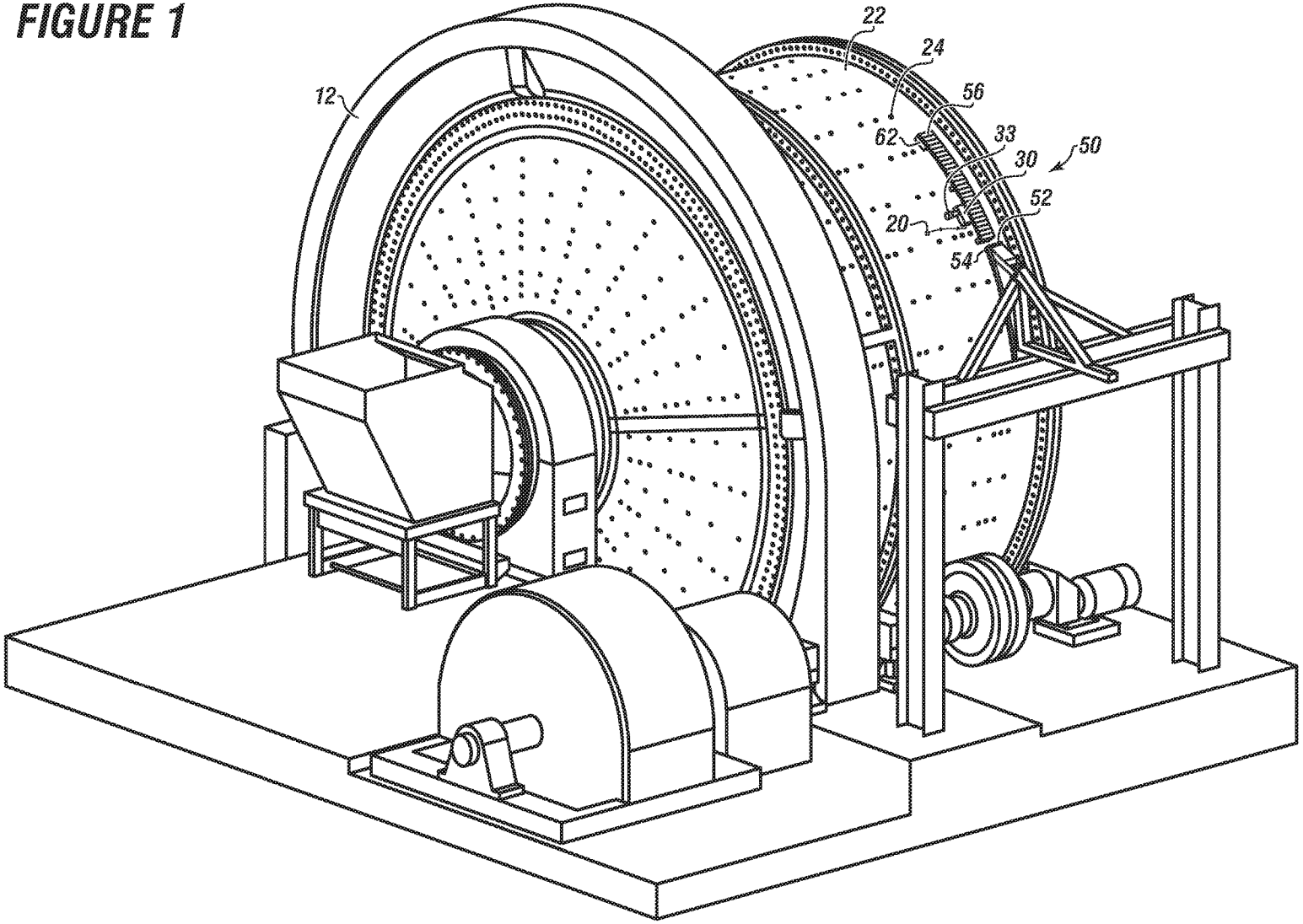
FIG. 1 shows a perspective view of an autogenous mill or a semi-autogenous mill according to one or more embodiments.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The present embodiments generally relate to a system to monitor the flow of material that constitutes a charge portion rather than a discharge portion in autogenous (AG) and semi-autogenous (SAG) mill for grinding particulates, such as ores while the mill is in operation.

The system can monitor in real time a charge volume of an autogenous or semi-autogenous mill without using auxiliary energy and controls the charge volume as the charge volume enters the mill to prevent overfill of the mill.

The autogenous mill (AG) or semi-autogenous mill (SAG) for grinding particulate can have a feed inlet for flowing feed particulate into the mill. The feed particulate is also known as "the charge" in the mining and milling industries.

The mill can have a rotatable mill shell, which can have liner bolts that can penetrate through the rotatable mill shell. In embodiments, lifting plates can be used for lifting particulate within the rotatable mill liner.

The system can use one or more accelerometers directly welded onto or otherwise connected to a rotatable mill shell, each accelerometer producing acceleration over time signal.

In embodiments, the one or more accelerometers can be connected to a wireless antenna and a signal receiver module, which can be directly connected onto the rotatable mill shell.

In embodiments, the system on the rotatable mill shell can be powered by a power conditioning unit, part of which can be mounted to the rotatable mill shell and part of which can be mounted to a fixed bracket adjacent the rotatable mill shell. In embodiments, the power conditioning unit can be a modular magnetic power generator unit.

In embodiments, the wireless antenna, the signal receiver module, or both the wireless antenna and the signal receiver module can be a computer or a central processing unit.

A radio antenna can be mounted to the rotatable mill shell, and can be used for communicating the signals from the wireless antenna and the signal receiver module to a master control processor with a master control data storage that can also be connected to a network as well as to a distributed control system of the mill.

The master control processor can use preset charge limits to prevent overfill of ore into the mill. The preset charge limits can be stored in a connected master control data storage as well as computer instructions that can instruct the master control processor to (i) receive the acceleration over time signals from the radio antenna, (ii) compare the acceleration over time signals to the preset charge limits, and (iii) provide commands to a distributed control system for the mill to enable the distributed control system to automatically alter at least one of: speed of the rotatable mill shell, particulate feed rate, and water feed rate when the compared acceleration over time signals exceed or fall below the preset charge limits.

In embodiments, the master control processor can be a computer or a central processing unit.

Autogenous or semi-autogenous mills grind particulate, such as ore. These mills all can have rotatable liners.

The rotatable liners allow the particulate, (known in the industry as particulate charge) such as iron ore, to rotate, then internal lifter plates of the rotatable liner raise the ore up and produce the grinding of the initial charge of ore. Slots can be within the mill, which can allow ground particulate to exit the mill when particulate reaches an appropriate size.

Particulate charge can be harder than expected, causing a longer residence time in the mill than expected and if equipment is not adjusted the feed charge causes the mill to overfill, burn out motors and cause environmental spills.

The present invention is designed to provide real time monitoring, real time alarms, and real time information to the distributed control center of the mill, along with client devices connected to a network, enabling the mill to automatically adjust the water feed rates, the charge feed rates, and the spin of the rotatable mill liner, as well, as other equipment while alerting operators, that changes are required at a certain mill to prevent damage, and even death of nearby workers if the mill explodes due to particulate back up.

The system manages and optimizes through put for the mill and optimizes liner life.

Accelerometers are not strain gauges and provide different measurements.

The system enables inductive transfer of energy for monitoring feed charge volumes of particulates entering the mill to prevent mill overflow.

The real time monitoring and alarm system of the invention requires no additional power to operate and has several benefits, such as the prevention of death of maintenance personnel by reducing the amount of time maintenance personnel are required to work in dangerous confined space environments.

Another benefit of the system is that the system stops environmental harm by using less electrical power for ore grinding by lowering specific energy consumption by the mill and by carefully controlling feed rates and materials used for feed rates.

Another benefit of the system is that the system stops environmental harm by using less metal for ore grinding by lowering specific metal consumption by the mill.

Another benefit of the system is that the system stops fires by requiring less use of dangerous welding and cutting of metal parts for repair of liners and installation on liners.

Still another benefit of the system is that the system stops explosions by requiring less use of dangerous welding equipment and less cutting of metal parts for the mill.

Yet another benefit of the system is that the system stops dismemberment of mill workers by extending the life of the mill liners which requires less labor inside the dangerous interior of the mill.

Additionally the system improves mill throughput by more efficiently targeting the ore charge inside the mill to fall upon itself for more efficient particle breakage.

The term "set points" as used herein can refer to an action by the master control processor using process variables supplied by the distributed control system of the mill to generate ideal set points to maximum feed through put without overfilling the mill.

The term "data storage" as used herein refers to a non-transitory computer readable medium, such as a hard disk drive, solid state drive, flash drive, tape drive, and the like. The term "non-transitory computer readable medium" excludes any transitory signals but includes any non-transitory data storage circuitry, e.g., buffers, cache, and queues, within transceivers of transitory signals.

The term "electromagnetic coils" as used herein can refer to a plurality of coils, wherein each coil can have windings that when energized by one or more magnetic fluxes generate an AC current.

The term "magnets" as used herein can refer to a rare earth magnet. In embodiments, each magnet or plurality of magnets can be a member of the group: a neodymium magnet, a samarium cobalt magnet, a ceramic magnet, and combinations thereof. In embodiments each magnet of the plurality of magnets can be of a geometric shape including but not limited to a ring, a cube, a sphere, a wedge, or a rectangle. In embodiments, the magnets can be dog boned shaped. Usable magnets, for example, can be similar to magnets which can be obtained from CMS Magnetics of Garland Texas.

The term "magnetic flux" as used herein can refer to the magnetic field generated by individual magnets.

The term "particulate" as used herein can refer to but is not limited to ore or ground particles, such as for smelting or for use in roadways.

The term "processor" as used herein can refer to a computer or a programmable logic controller (PLC).

The terms "radio antenna" and "wireless antenna" as used herein can refer to a bidirectional antenna that can receive and transmit radio signals, such as a Wi-Fi antenna.

The term "semi-autogenous grinding mill" or SAG mill as used herein can refer to an essentially autogenous mill, but utilize grinding balls to aid in grinding like in a ball mill inside a rotatable mill liner. A SAG mill is generally used as a primary or first stage grinding solution. SAG mills can use a ball charge of 8 percent to 21 percent. As an example, the largest SAG mill is about 42 inches in diameter, powered by a 28 MW (38,000 HP) motor. As another example, a SAG mill with a 44 inch diameter can be used and powered of 35 MW (47,000 HP) motor. Attrition between grinding balls and ore particles causes grinding of finer particles. SAG mills are characterized by their large diameter and short length as compared to ball mills. The inside of the SAG mill can be lined with lifting plates to lift the material inside the mill, where it then falls off the plates onto the rest of the ore charge. SAG mills are primarily used at gold, copper and platinum mines with applications also in the lead, zinc, silver, alumina and nickel.

The term "without using auxiliary energy" as used herein can refer to the condition that the system only uses the preexisting spin of the rotatable mill shell along with magnets to create power to operate the system.

Turning now to the Figures, FIG. 1 shows a perspective view of an autogenous mill (AG) or a semi-autogenous mill (SAG) according to one or more embodiments.

The autogenous mill or the semi-autogenous mill 12 can have a rotatable mill shell 22 and liner bolts 24.

In embodiments, parts of a modular magnetic power generating unit 50 can be attached to and adjacent the rotatable mill shell 22. The modular magnetic power generating unit 50 can have at least one magnet 54 of a plurality of magnets connected to a non-rotating bracket 52. In embodiments, the non-rotating bracket 52 can be mounted adjacent the rotatable mill shell 22.

The modular magnetic power generating unit 50 can have a power conditioning unit 62, which can be mounted to the rotatable mill shell 22. In embodiments, the power conditioning unit 62 can be configured to receive an AC current from at least one electromagnetic coil 56 of a plurality of electromagnetic coils. The at least one electromagnetic coil 56 can be aligned to be energized by at least one magnet 54 when the rotatable mill shell 22 rotates.

The power conditioning unit 62 can transform AC current to DC current. The DC current can be used to power a wireless antenna 33 and a signal receiver module 30. The signal receiver module 30, which can contain the wireless antenna 33, can be attached to the rotatable mill shell 22. In embodiments, the wireless antenna can be attached to the signal receiver module 30 or to the rotatable mill shell 20.

In embodiments, at least one accelerometer 20 can be connected to the rotatable mill shell 20 or at least one of the liner bolts 24 of the autogenous mill or the semi-autogenous mill 12.

Figure 2:
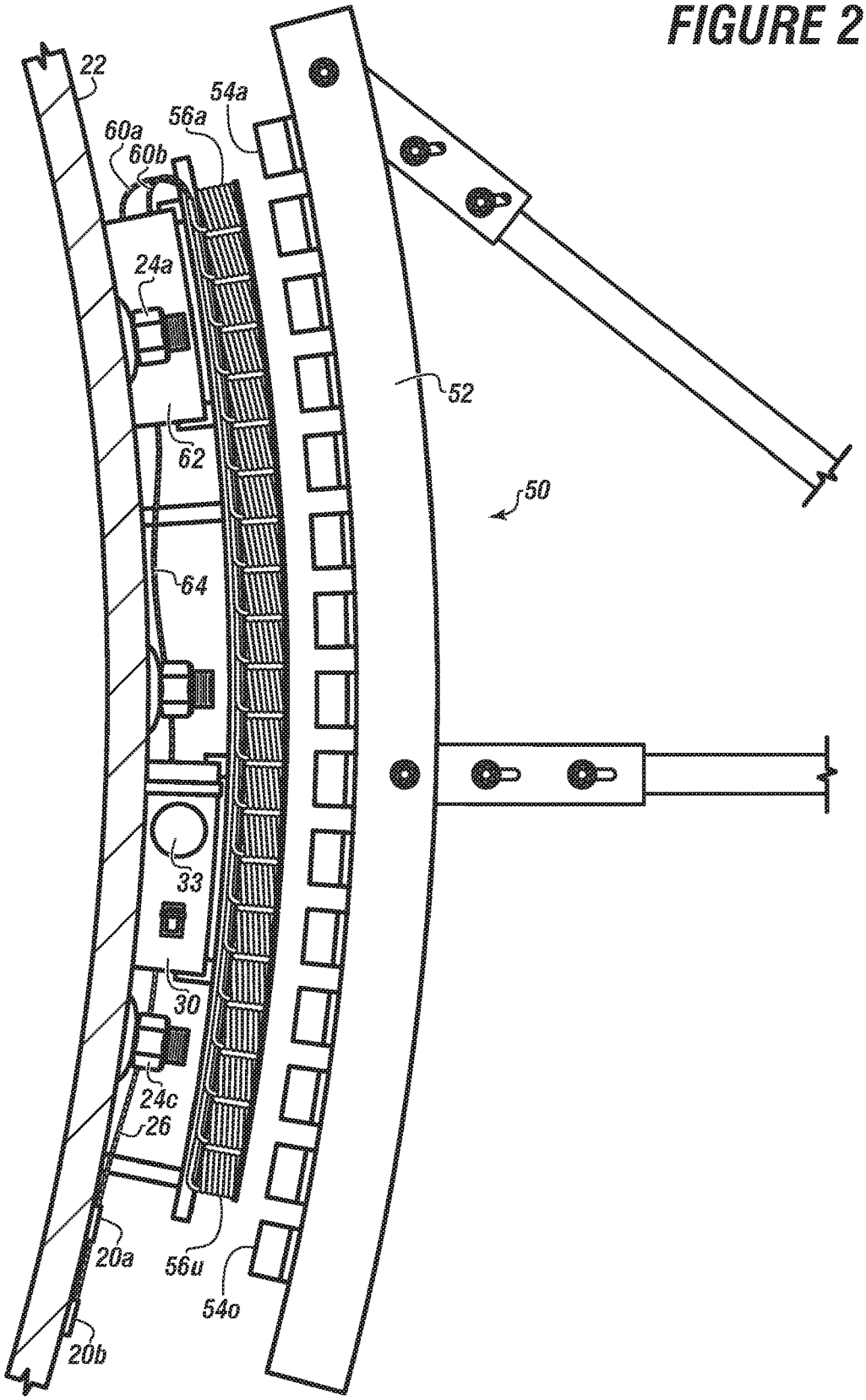
FIG. 2 is a side view of a modular magnetic power generating unit according to one or more embodiments.

FIG. 2 shows a side view of the modular magnetic power generating unit according to one or more embodiment.

In embodiments, the modular magnetic power generating unit 50 can have a power conditioning unit 62 to receive AC current 60*a* and 60*b* from at least one electromagnetic coil of the plurality of magnetic coils 56*a*-56*u*. While twenty one electromagnetic coils 56*a*-56*u* are shown, any number of electromagnetic coils can be used depending upon application.

The plurality of electromagnetic coils 56*a*-56*u* can produce AC current 60*a* and 60*b* when at least one electromagnetic coil of the plurality of electromagnetic coils 56*a*-56*u* is energized by passing at least one magnet of the plurality of magnetics 54*a*-54*o*, which can be attached to the non-rotating bracket 52, as the rotatable mill shell 22 rotates. While fifteen magnets 54*a*-54*o* are shown, any number of magnets can be attached to the non-rotating bracket 52 depending upon application.

Each magnet of the plurality of magnets 54*a*-54*o* can be a rare earth magnet. IN embodiments, each magnet can be a neodymium magnet, a samarium cobalt magnet, a ceramic magnet, or combinations thereof.

In embodiments, the plurality of magnets can be mounted in a linear sequence. In other embodiments, the magnets can be grouped into sets of magnets. Each magnet generates a magnetic flux.

Each electromagnetic coil is depicted to be aligned and to be energized with the plurality of magnets as each electromagnetic coil is spun under the magnets as the rotatable mill shell rotates.

Each electromagnetic coil generates AC current which can be combined into one AC current or multiple AC currents when energized by the plurality of magnetic fluxes.

In embodiments, the power conditioning unit 62 can transform AC current 60*a* and 60*b* to DC current 64 generated by the plurality of electromagnetic coils and can then transfer the DC current for use. The DC current can be used to power the signal receiver module 30, the wireless antenna 33, the signal receiver module 30, or both the signal receiver module and the wireless antenna.

In embodiments, the DC current can be from 1 volt to 24 volts.

The signal receiver module 30 can receive acceleration over time signals 26 from the at least one accelerometer 20*a* and 20. More than one accelerometer can be used to send the acceleration over time signals 26 to the signal receiver module 30. If more than one accelerometer is used, the accelerometers can be connected in parallel, in series, or combinations thereof.

In embodiments, the at least one accelerometer 20*a* and 20*b* can be attached to the rotatable mill shell 22 or at least one of the liner bolts 24*a*-24*c*.

Figure 3:
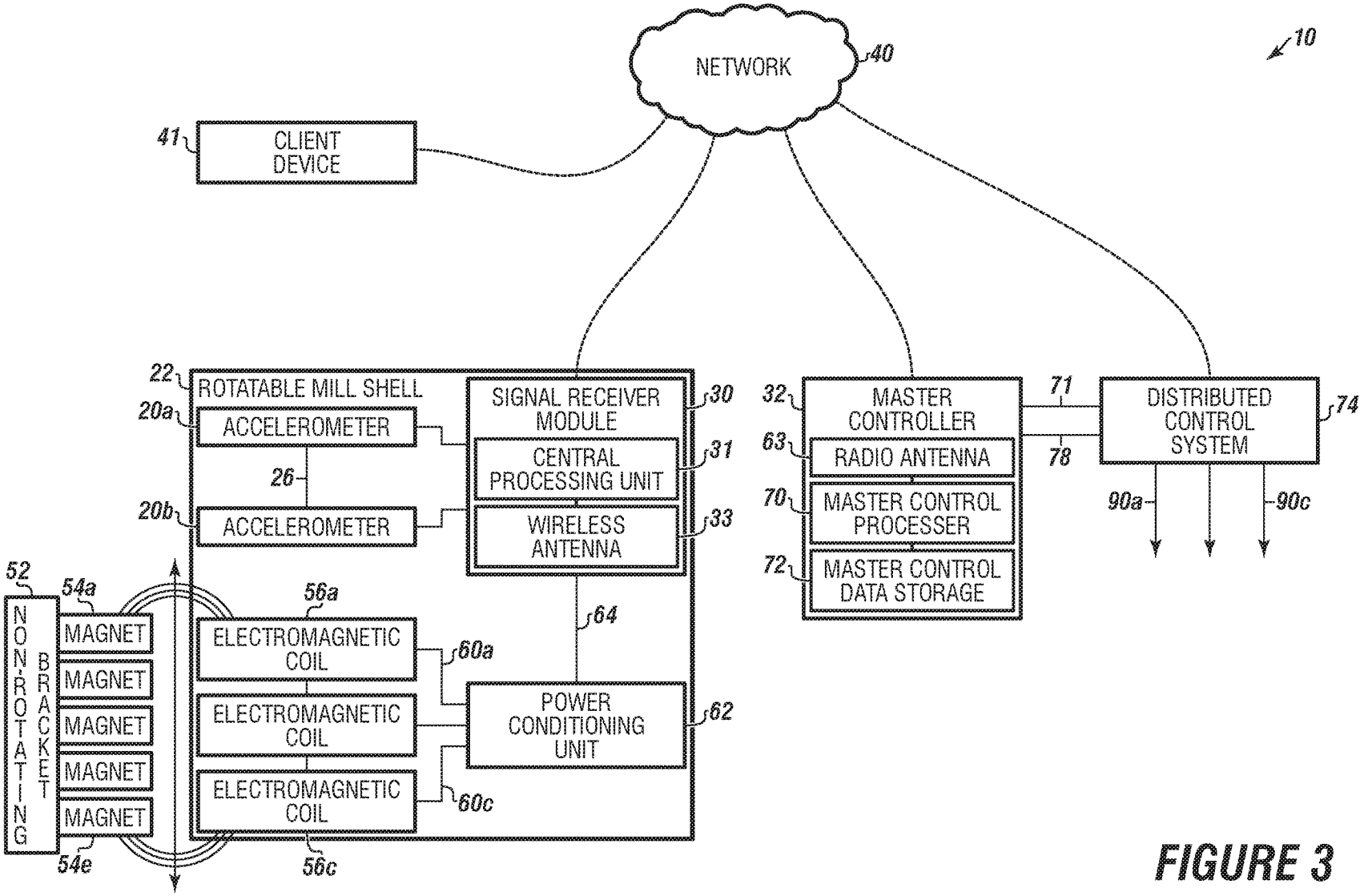
FIG. 3 shows a diagram of the assembled system according to one or more embodiments.

FIG. 3 shows a diagram of the assembled system according to one or more embodiments.

The system 10 can include the plurality of electromagnetic coils 56*a*-56*c*, which is shown, attached to the rotatable mill shell 22. The plurality of electromagnetic coils 56*a*-56*c* can become energized and produce AC current 60*a*-60*c* as they rotate past the plurality of magnets 54*a*-54*e*, which can be attached to the non-rotating bracket 52, which is shown adjacent the rotatable mill shell.

The power conditioning unit 62 can transform the AC current 60*a*-60*c* into DC current 64 and send the DC current to provide power to the signal receiver module 30.

The signal receiver module 30 can receive acceleration over time signals 26 from the at least one accelerometer 20*a*-20*b* and transmit the acceleration over time signals 26 to a network 40 using a central processing unit 31 and a wireless antenna 33. The central processing unit 31, the wireless antenna 33 or both the central processing unit and the wireless antenna can be configured to receive transmissions from the network 40.

In embodiments, the network 40 can be at least one of: a local area network, a wide area network, a global communication network, a satellite network, a cellular network, a similar network, or combinations thereof.

A master controller 32 can be connected to the network 40 and can contain a radio antenna 63, a master control processor 70, and a master control data storage 72. In embodiments, the radio antenna 63 can be connected to the master controller 32.

The radio antenna 63 can receive signals via the network 40 from the wireless antenna 33 of the signal receiver module 30.

The master control processor 70 can be in communication with the master control data storage 72. The master control processor 70 can be connected to the network 40 and to a distributed control system 74 for the autogenous mill or the semi-autogenous mill.

The a master control processor 70 can receive and use process variables 71 from the distributed control system 74 and can receive and use the acceleration over time signals 26 to compute and transmit a plurality of setpoints 78 to the distributed control system 74.

In embodiments, examples of the plurality of setpoints can be rotational speed of the rotatable mill shell, such as a number of rotations per minute for the mill that has a rotatable mill shell, a water feed rate, such as a number of gallons per minute for the mill, a particulate feed rate, which can vary from the number of tons per hour of particulate, such as iron ore, into the mill, or combinations thereof.

At least one client device 41 can be connected to the network 40, which can enable an operator to receive alarms or information about mill processing conditions. The client device can be a computer, a laptop, a cellular phone, a tablet computer, a similar computing device, or combinations thereof.

The distributed control system 74 can transmit manipulated variables 90*a*-90*c*, such as new rotational speeds, new water feeds rates, new particulate feeds rates, new rotational speeds, or combinations thereof, to the system or actual components of the autogenous mill or the semi-autogenous mill.

Figure 4:
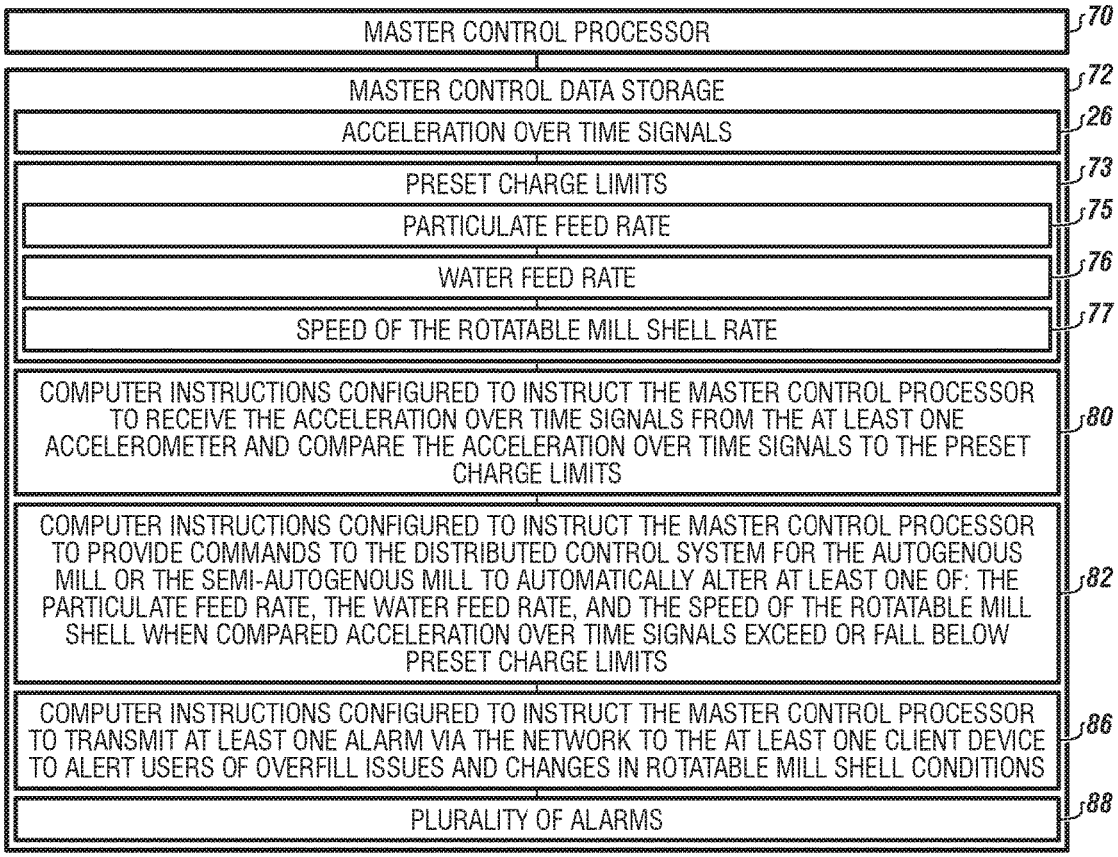
FIG. 4 shows a diagram of a master control processor and a master control data storage according to one or more embodiments.

FIG. 4 shows a diagram of a master control processor and a master control data storage according to one or more embodiments.

In embodiments, the master control processor 70 and the master control data storage 72 can be in communication with one another.

Acceleration over time signals 26 can be stored in the master control data storage 72 for use in generating alarms, or use in generating a log of changes to the distributed control system of the autogenous mill or the semi-autogenous mill.

The master control data storage 72 can contain preset charge limits 73 to prevent overfills of particulate, such as ore into the autogenous mill or the semi-autogenous mill.

The preset charge limits 73 can include but are not limited to a particulate feed rate 75, a water feed rate 76, and the speed of the rotatable mill shell rate 77.

The master control data storage 72 can contain computer instructions 80 configured to instruct the master control processor to receive the acceleration over time signals from the at least one accelerometer and compare the acceleration over time signals to the preset charge limits.

The master control data storage 72 can contain computer instructions 82 configured to instruct the master control processor to provide commands to the distributed control system for the autogenous mill or the semi-autogenous mill to automatically alter at least one of: the particulate feed rate, the water feed rate, and the speed of the rotatable mill shell when compared acceleration over time signals exceed or fall below preset charge limits.

The master control data storage 72 can contain computer instructions 86 configured to instruct the master control processor to transmit at least one alarm via the network to the at least one client device to alert users of overfill issues and changes in rotatable mill shell conditions.

A plurality of alarms 88 can be stored in the master control data storage 72 for viewing historically and to facilitate maintenance on the autogenous mill or the semi-autogenous mill.

Figure 5:
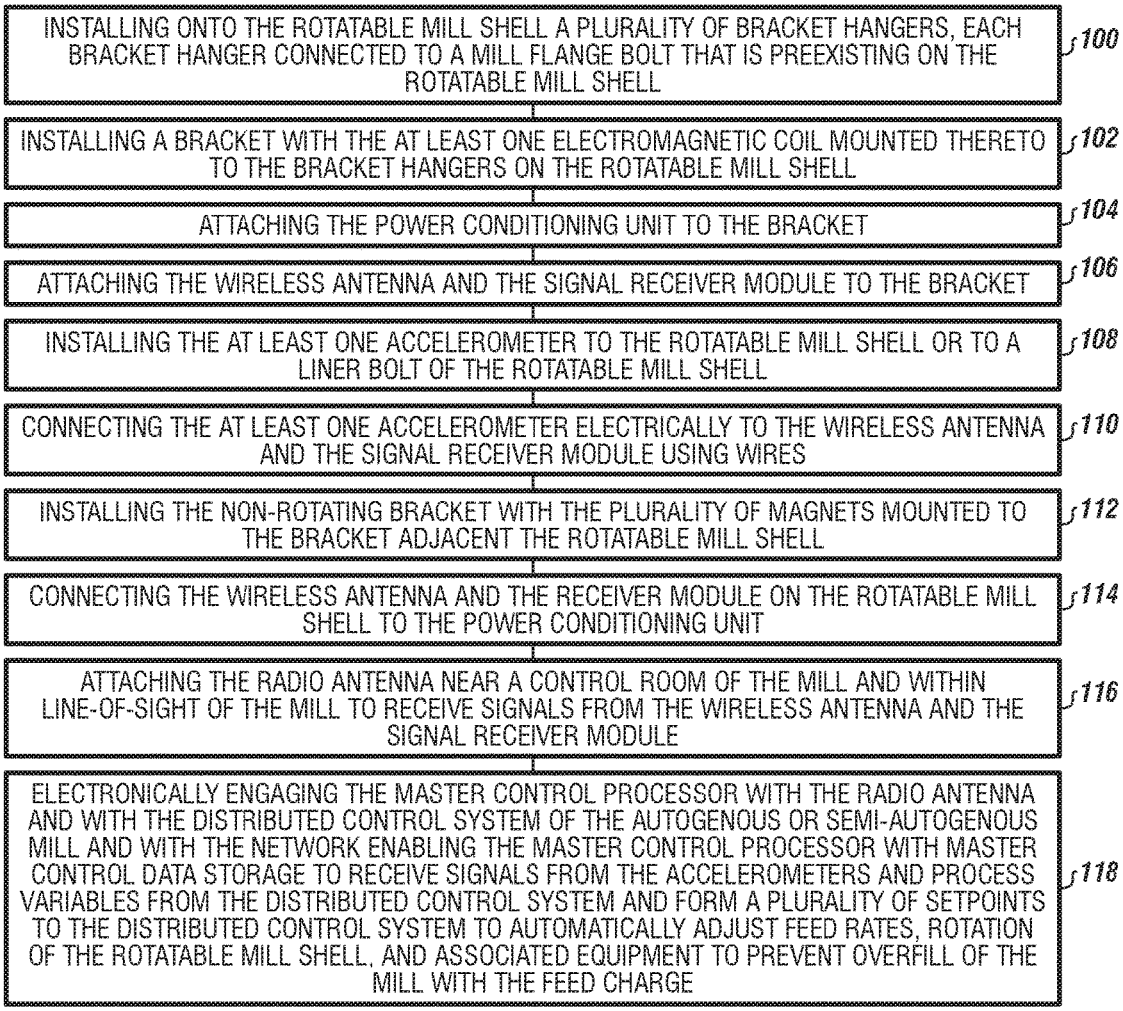
FIG. 5 shows a diagram of the steps for installation of the system according to one or more embodiments.

FIG. 5 shows a diagram of the method for installation of the system according to one or more embodiments.

The method for installation of the system can include installing onto the rotatable mill shell a plurality of bracket hangers, each bracket hanger connected to a mill flange bolt that is preexisting on the rotatable mill shell, as illustrated in step 100.

In embodiments, the bracket hangers can be attached in any manner suitable for application, such as by welding.

The method for installation of the system can include installing a bracket with the at least one electromagnetic coil mounted thereto to the bracket hangers on the rotatable mill shell, as illustrated by step 102.

The method for installation of the system can include attaching the power conditioning unit to the bracket, as illustrated by step 104.

The method for installation of the system can include attaching the wireless antenna and the signal receiver module to the bracket, as illustrated by step 106.

The method for installation of the system can include installing the at least one accelerometer to the rotatable mill shell or to a liner bolt of the rotatable mill shell, as illustrated by step 108.

The method for installation of the system can include connecting the at least one accelerometer electrically to the wireless antenna and the signal receiver module using wires, as illustrated by step 110.

The method for installation of the system can include installing the non-rotating bracket with the plurality of magnets mounted to the bracket adjacent the rotatable mill shell, as illustrated by step 112.

In embodiments, the non-rotating bracket with the plurality of magnets mounted the bracket adjacent the rotation mill shell can be mounted from ¼ of an inch to 1 inch from the rotatable mill shell.

The method for installation of the system can include connecting the wireless antenna and the receiver module on the rotatable mill shell to the power conditioning unit, as illustrated by step 114.

The method for installation of the system can include attaching the radio antenna near a control room of the mill and within line-of-sight of the mill to receive signals from the wireless antenna and the signal receiver module, as illustrated by step 116.

The method for installation of the system can include electronically engaging the master control processor with the radio antenna and with the distributed control system of the autogenous or semi-autogenous mill and with the network enabling the master control processor with master control data storage to receive signals from the accelerometers and process variables from the distributed control system and form a plurality of setpoints to the distributed control system to automatically adjust feed rates, rotation of the rotatable mill shell, and associated equipment to prevent overfill of the mill with the feed charge, as illustrated by step 118.

While these embodiments have been described with emphasis on the embodiments, it should be understood that within the scope of the appended claims, the embodiments might be practiced other than as specifically described herein.

What is claimed is:

1. A system to control in real time a charge volume of an autogenous mill or a semi-autogenous mill for grinding particulate, without using auxiliary energy, the system comprising:

a. at least one accelerometer connected to a rotatable mill shell of the autogenous mill or the semi-autogenous mill or liner bolts of the rotatable mill shell producing acceleration over time signals;

b. a wireless antenna and a signal receiver module electrically connected to the at least one accelerometer and mounted to the rotatable mill shell for receiving and transmitting the acceleration over time signals to a network;

c. a modular magnetic power generator unit comprising:

(i) a non-rotating bracket mounted adjacent the rotatable mill shell;

(ii) a plurality of magnets, each magnet of the plurality of magnets generates a magnetic flux, each magnet of the plurality of magnets mounted to the non-rotating bracket;

(iii) a plurality of electromagnetic coils mounted to the rotatable mill shell, each electromagnetic coil of the plurality of electromagnetic coils aligned to be energized with the plurality of magnets, each electromagnetic coil of the plurality of electromagnetic coils generating an AC current when energized by the magnetic flux; and (iv) a power conditioning unit mounted to the rotatable mill shell, the power conditioning unit receiving and transforming the AC current to a DC current which supplies power to the wireless antenna and the signal receiver module;

d. a radio antenna for receiving signals from the wireless antenna and the signal receiver module;

e. a master controller with a master control processor and a master control data storage connected to the network and to a distributed control system to receive and use process variables from the distributed control system and the acceleration over time signals to compute and transmit a plurality of setpoints to the distributed control system of the autogenous mill or the semi-autogenous mill, the master control data storage comprising:

(i) preset charge limits for to prevent overfill of the particulate into the autogenous mill or the semi-autogenous mill;

(ii) computer instructions to instruct the master control processor to receive the acceleration over time signals and compare the acceleration over time signals to the preset charge limits; and (iii) computer instructions to instruct the master control processor to provide commands to the distributed control system for the autogenous mill or the semi-autogenous mill to automatically alter at least one of:

a speed of the rotatable mill shell rate, a particulate feed rate, and a water feed rate when compared acceleration over time signals exceed or fall below the preset charge limits.

2. The system of claim 1, further comprising at least one client device connected to the network to receive information from the master control processor when the plurality of setpoints are transmitted to the autogenous mill or the semi-autogenous mill.

3. The system of claim 1, comprising from 1 accelerometer to 50 accelerometers electrically connected in parallel with the wireless antenna and the signal receiver module.

4. The system of claim 1, wherein each magnet of the plurality of magnets is a rare earth magnet.

5. The system of claim 4, wherein each magnet of the plurality of magnets is a member of the group: a neodymium magnet, a samarium cobalt magnet, a ceramic magnets, or combinations thereof.

6. The system of claim 1, wherein the preset charge limits comprise:

a. the speed of the rotatable mill shell rate in rotations per minute;

b. the particulate feed rate; and c. the water feed rate.

7. The system of claim 1, wherein each electromagnetic coil of the plurality of electromagnetic coils has from 200 windings to 2000 windings.

8. The system of claim 1, wherein the wireless antenna, the signal receiver module, or both the wireless antenna and the signal receiver module are a computer or a central processing unit.

9. The system of claim 1, wherein the master control processor is a computer or a central processing unit.

10. The system of claim 1, wherein the network is at least one of: a local area network, a wide area network, a global communication network, a satellite network, and a cellular network, or combinations thereof.

11. The system of claim 2, comprising computer instructions to instruct the master control processor to transmit at least one alarm via the network to the at least one client device to alert users of overfill issues and changes in the rotatable mill shell conditions.

12. The system of claim 1, wherein the master controller is connected to a radio antenna.

* * * * *